US006941716B2

(12) United States Patent
Kottman

(10) Patent No.: US 6,941,716 B2
(45) Date of Patent: Sep. 13, 2005

(54) UNIVERSAL WALL PANEL TILE CONNECTOR

(75) Inventor: Mark A. Kottman, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/262,781

(22) Filed: Oct. 2, 2002

(65) Prior Publication Data

US 2004/0065024 A1 Apr. 8, 2004

(51) Int. Cl.[7] ..... E04B 2/30

(52) U.S. Cl. ..... 52/489.1; 52/489.2; 52/481.2; 52/357; 52/238.1; 52/712; 52/714; 52/36.1; 248/220.1

(58) Field of Search ..... 52/489.1, 489.2, 52/481.2, 357, 712, 714, 36.1, 238.1, 775; 248/220.1

(56) References Cited

U.S. PATENT DOCUMENTS

| | | | | | |
|---|---|---|---|---|---|
| 1,719,200 | A | | 7/1929 | Schumacher | |
| 1,941,216 | A | * | 12/1933 | McKeown | 52/545 |
| 2,227,570 | A | * | 1/1941 | Burson | 52/489.1 |
| 2,305,122 | A | * | 12/1942 | Wiley | 52/466 |
| 2,335,302 | A | | 11/1943 | Olsen | |
| 2,591,361 | A | * | 4/1952 | Knott | 52/489.1 |
| 2,663,390 | A | | 12/1953 | Dordel | |
| 2,666,245 | A | * | 1/1954 | Fernberg | 248/73 |
| 2,831,222 | A | * | 4/1958 | Anderson | 52/489.1 |
| 2,857,633 | A | * | 10/1958 | Bunker | 49/482.1 |
| 3,020,988 | A | * | 2/1962 | Bransford | 52/512 |
| 3,232,018 | A | | 2/1966 | MacKean | |
| 3,290,847 | A | * | 12/1966 | Fenwick | 52/489.1 |
| 3,300,934 | A | * | 1/1967 | Waizenhofer | 52/394 |
| 3,438,168 | A | * | 4/1969 | Tischuk | 52/478 |
| 3,732,660 | A | | 5/1973 | Byssing | |
| 3,906,695 | A | * | 9/1975 | Pilgrim et al. | 52/489.2 |
| 3,921,253 | A | * | 11/1975 | Nelson | 16/257 |
| 3,922,764 | A | * | 12/1975 | Downing, Jr. | 52/481.2 |
| 3,998,419 | A | * | 12/1976 | Semmerling | 248/323 |
| 4,092,766 | A | * | 6/1978 | Meyer | 24/295 |
| 4,128,979 | A | | 12/1978 | Price | |
| 4,141,191 | A | * | 2/1979 | Aarons | 52/715 |
| 4,296,530 | A | * | 10/1981 | Muller et al. | 24/295 |
| 4,307,976 | A | * | 12/1981 | Butler | 405/118 |
| 4,377,060 | A | * | 3/1983 | Ragland | 52/489.2 |
| 4,429,508 | A | * | 2/1984 | Sizemore | 52/713 |
| 4,567,706 | A | * | 2/1986 | Wendt | 52/489.2 |
| 4,575,983 | A | * | 3/1986 | Lott et al. | 52/544 |
| 4,700,515 | A | * | 10/1987 | Menchetti et al. | 52/126.1 |
| 4,704,835 | A | * | 11/1987 | Jordan | 52/489.1 |
| 4,782,638 | A | * | 11/1988 | Hovind | 52/547 |
| 4,856,744 | A | * | 8/1989 | Frankel | 248/215 |
| 5,101,540 | A | * | 4/1992 | Roof et al. | 24/458 |
| 5,107,651 | A | | 4/1992 | Menchetti et al. | |
| 5,175,969 | A | * | 1/1993 | Knauf et al. | 52/239 |
| 5,216,859 | A | * | 6/1993 | Moreno et al. | 52/238.1 |
| 5,347,690 | A | * | 9/1994 | Mansoor et al. | 24/295 |
| 5,392,579 | A | * | 2/1995 | Champagne | 52/520 |

(Continued)

*Primary Examiner*—Robert Canfield
*Assistant Examiner*—Christy M. Green
(74) *Attorney, Agent, or Firm*—Joseph H. Golant; Jones Day

(57) ABSTRACT

A wall panel tile connector is disclosed. The connector includes an elongated bracket with groups of openings and a number of clips which are attached to the bracket by use of the openings. The bracket has a first portion with an U-shaped cross section, a middle portion with an offset and a second portion. The offset has a slot-like opening and the second portion includes two smaller openings, the three openings being grouped to allow attachment of a clip. Each clip is generally U-shaped with a base and two legs, and a bent tab and offset fingers. The slot-like opening receives one of the legs of the clip. The offset fingers engage in the smaller openings and create an interference fit with the bracket. The tab is resilient and enables the tile to be engaged with a wall panel frame.

9 Claims, 5 Drawing Sheets

U.S. PATENT DOCUMENTS 5,408,796 A * 4/1995 Hashimoto et al. ..... 52/489.2
5,526,553 A * 6/1996 Klein ..... 24/295
5,564,245 A * 10/1996 Rademacher ..... 52/520
5,564,246 A * 10/1996 Champagne ..... 52/548
5,590,502 A * 1/1997 Wendt ..... 52/489.2
5,622,020 A * 4/1997 Wood ..... 52/546
5,632,127 A * 5/1997 Agar et al. ..... 52/481.2
5,634,314 A * 6/1997 Champagne ..... 52/712
5,802,789 A * 9/1998 Goodman et al. ..... 52/239
5,911,663 A * 6/1999 Eidson ..... 52/520
6,000,180 A * 12/1999 Goodman et al. ..... 52/239
6,367,220 B1 * 4/2002 Krause et al. ..... 52/512

* cited by examiner

FIG 8
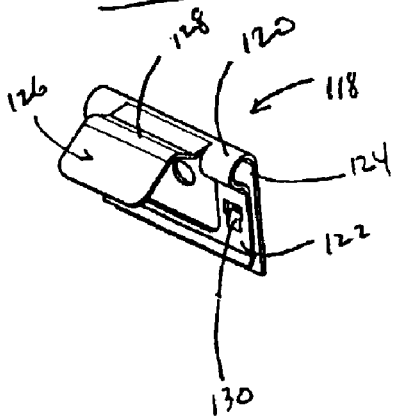
FIG 9
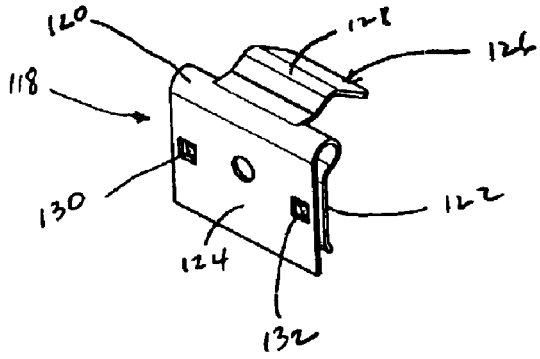
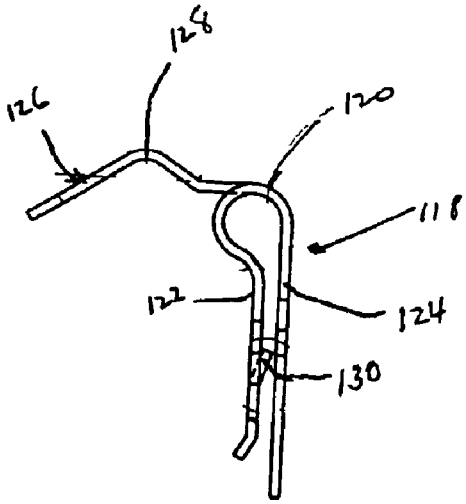
FIG 10

UNIVERSAL WALL PANEL TILE CONNECTOR

BACKGROUND OF THE INVENTION

1. Field of the Invention

The present invention relates to a tile connector and more particularly to a universal wall panel tile connector that is simple, reliable and relatively inexpensive.

2. Description of the Related Art

Many offices have moveable wall panel systems that include vertical supports and wall panel assemblies which may be variously configured to divide an office space into different work areas. Each wall panel assembly usually includes a rectangular frame and two oppositely disposed tiles that are decorative from color and texture standpoints.

Tiles are usually made of wood, plastic or metal panels covered with paint or stain, or other material such as fabric. There is, however, a limit to the type of wall surfaces available to a space planner.

BRIEF SUMMARY OF THE INVENTION

The limitations encountered with previous wall panel assemblies have been overcome by the present invention. What is described here is a universal tile connector comprising an elongated bracket having a first portion with a U-shaped channel configuration, a second portion in the form of a strip of generally constant cross section, and a third middle portion having an offset, the bracket including spaced apart openings, and the connectors also including a plurality of clips connected to the bracket, each of the clips being connected to the bracket in a corresponding one of the openings, the clips for connecting the bracket to a wall panel frame.

There are a number of advantages, features and objects achieved with the present invention which are believed not to be available in earlier related devices. For example, the tile connector of the present invention includes several advantages, namely, it is simple, inexpensive and yet reliable. Other objects of the present invention include a tile connector which is easy to use and versatile. Yet another feature is that the tile connector of the present invention is universal in that it may be used with existing tiles and with new tiles of more unusual or exotic designs.

A more complete understanding of the present invention and other objects, advantages and features thereof will be gained from the consideration of the following description of a preferred embodiment read in conjunction with the accompanying drawing provided herein. The embodiment represents an example of the invention which is described here in compliance with Title 35 U.S.C. § 112 (first paragraph), but the invention itself is defined by the attached claims.

BRIEF DESCRIPTION OF THE SEVERAL VIEWS OF THE DRAWING

FIG. 8 is a front isometric view of a top clip of the universal connector.

FIG. 9 is a rear isometric view of the top clip.

FIG. 10 is an enlarged elevation view of the top clip.

DETAILED DESCRIPTION OF A PREFERRED EMBODIMENT OF THE INVENTION

Figure 1:
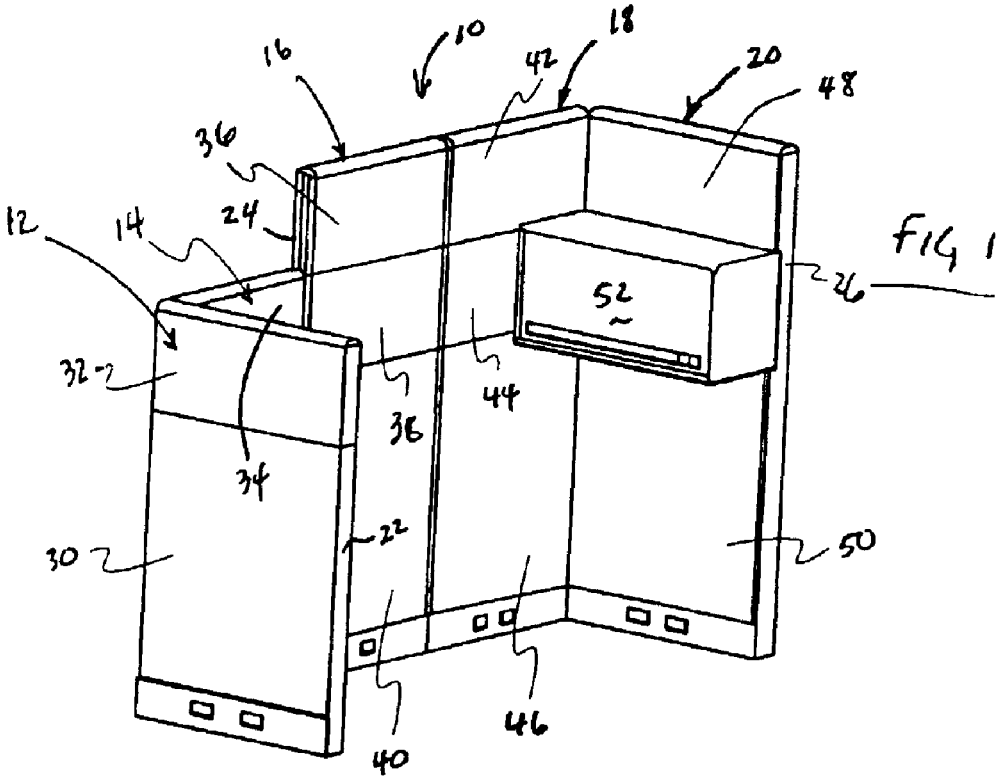
FIG. 1 is an isometric view of a moveable wall panel system.

While the present invention is open to various modifications and alternative constructions, the preferred embodiment shown in the various figures of the drawing will be described herein in detail. It is understood, however, that there is no intention to limit the invention of the particular embodiment, form or example disclosed. On the contrary, the invention is to cover all modifications, equivalent structures and methods, and alternative constructions falling within the spirit and scope of the invention as expressed in the appended claims, pursuant to Title 35 U.S.C. § 112 (second paragraph).

An example of a moveable panel wall system 10 is illustrated in FIG. 1 and includes a space comprising five wall panel sections 12, 14, 16, 18, 20. The system may include vertical supports 22, 24, 26 to which are attached base and stacker wall panel assemblies 30, 32, 34, 36, 38, 40, 42, 44, 46, 48, 50. The sections may be of different height and a cabinet 52 may be mounted to one of more of the sections.

Figure 2:
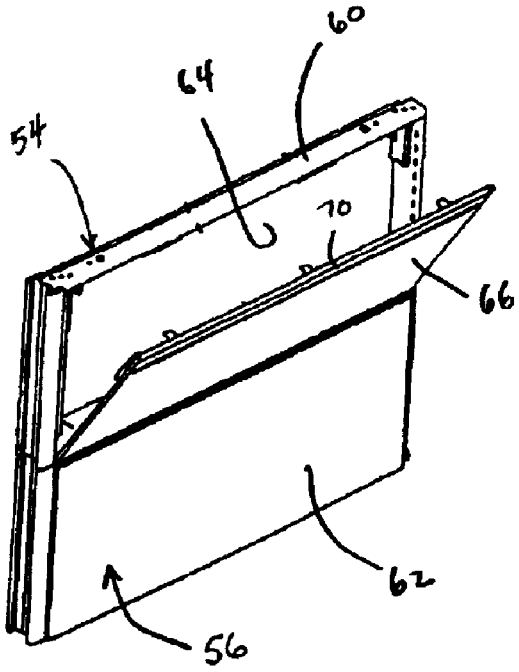
FIG. 2 is an enlarged isometric view of two wall panel assemblies with the upper stacking panel assembly being partially assembled.

A wall panel assembly 54, 56, FIG. 2, typically includes an outer frame, such as the frame 60, and decorative wall panels, such as the panels or tiles 62, 64, 66. As mentioned, these wall panels may be made of wood, plastic or metal and each may display a natural finish, a coating of paint or a layer of fabric wrapped around the panel depending upon the aesthetic appearance desired for the office space.

The frame 60 is rectangularly shaped and made of metal and the two tiles 64, 66 are connected to each side of the frame. Universal tile connectors, such as a top connector 70, are connected to the tiles at their upper horizontal edges and at their lower horizontal edges. The connectors include clips with springy tabs which are designed to engage the frame and keep the tiles in place.

Figure 3:
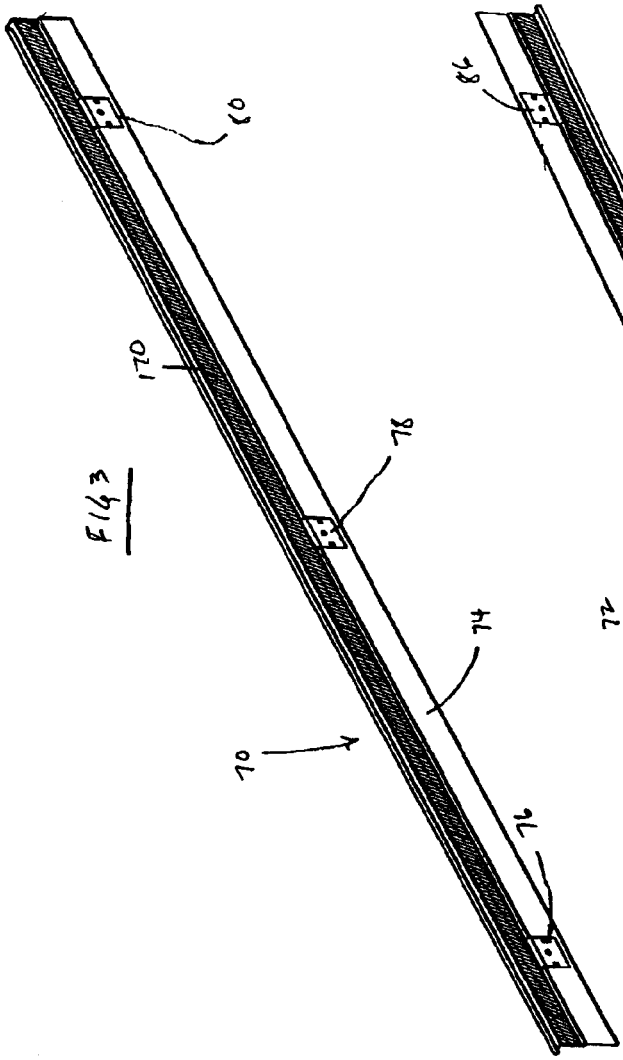
FIG. 3 is an isometric view of a top universal connector.
Figure 4:
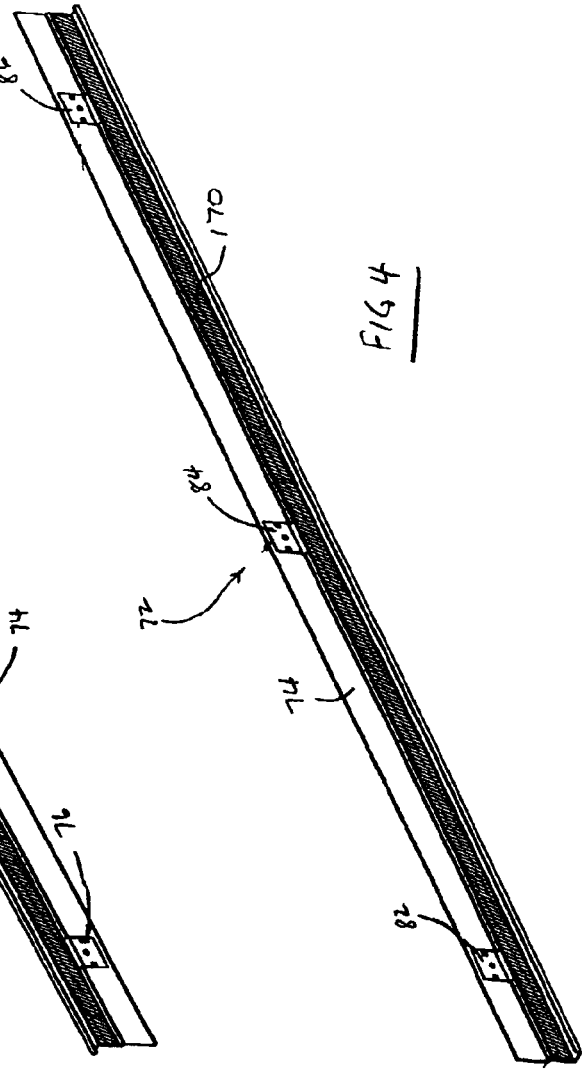
FIG. 4 is an isometric view of a bottom universal connector.

Referring now to FIGS. 3 and 4 the universal tile connectors are shown in more detail. The top connector 70 is illustrated in FIG. 3 and a bottom connector 72 is illustrated in FIG. 4. Each connector includes an identical elongated bracket 74 and each of the connectors include three clips, such as the three top clips 76, 78, 80 of the top connector 70 and the three bottom clips 82, 84, 86 of the bottom connector 72.

Figure 5:
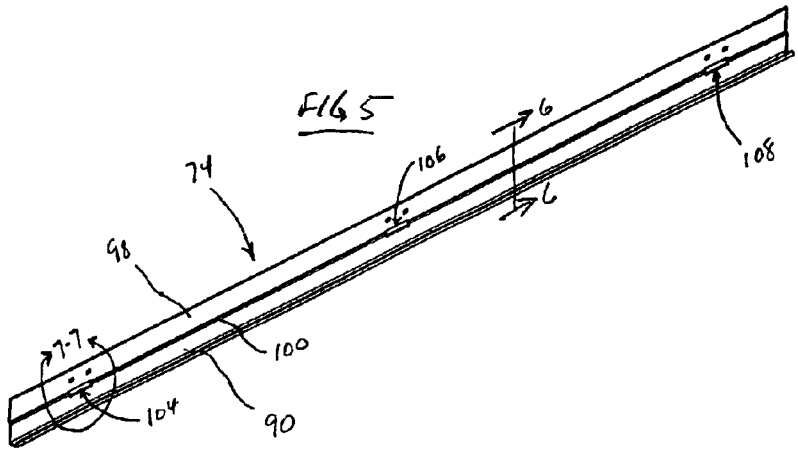
FIG. 5 is an isometric view of a bracket portion of a universal connector.
Figure 6:
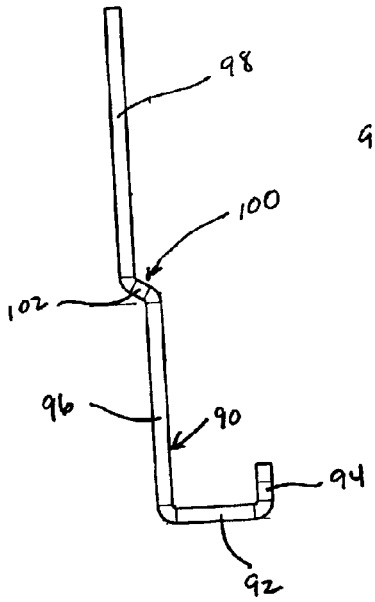
FIG. 6 is an enlarged section view of the bracket taken along line 6—6 of FIG. 5.
Figure 7:
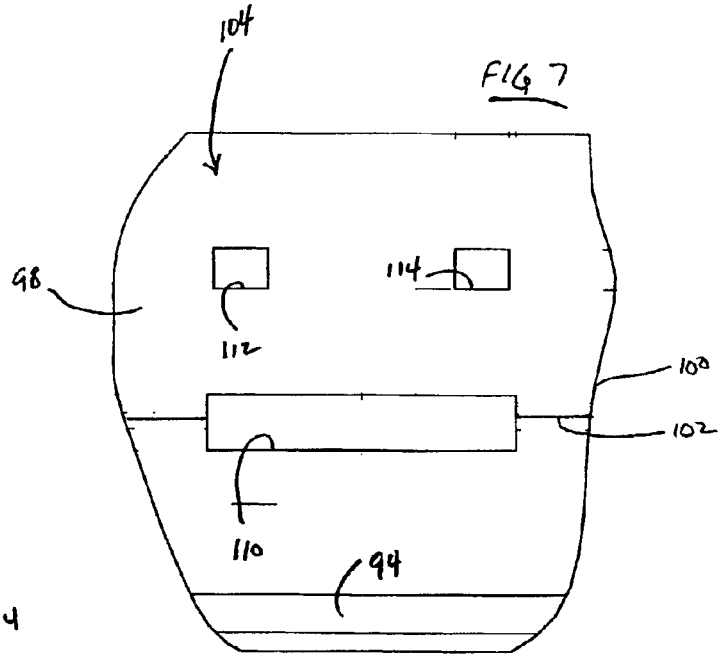
FIG. 7 is an enlarged elevation view of a portion of the bracket taken within the circle 7—7 of FIG. 5.

The bracket 74 is a stamped or extruded elongated piece having a first or lower portion 90, FIGS. 5–7 in a U-shaped configuration with a base 92, a short arm 94 and a long arm 96. A second or upper portion 98 is in the form of an elongated strip of generally consistent cross section and a middle portion 100 includes an offset 102. The bracket also includes three groups or clusters of openings or apertures 104, 106, 108 where each group, such as the group 104, includes a rectangular-shaped or slot-like opening or aperture 110 and two smaller rectangular-shaped openings or apertures 112, 114 that are nearly square shaped. Each group of openings are arranged to help seat a clip. The slot-like opening is located in the middle portion 100 at the offset 102. The smaller openings are located in the upper portion 98 of the bracket. It is understood that the terms "upper" and "lower" are based on the orientation of the bracket shown in FIG. 5, which is the orientation of the bottom connector. The orientation of the top connector is upside down to the bottom connector so that the U-shaped configuration is uppermost; the structure is identical, just rotated one hundred and eighty degrees. It is also understood that more or less clips and groups of openings may be provided depending upon the length of the bracket. Shorter connectors may only use two clips, for example. The term "opening" is defined here as an aperture or hole as shown in FIGS. 5–7 and 14.

The bracket may extend in length from about twenty-three to about sixty inches, a height of about 1.75 inches, a space between the legs of about 0.285 inches, a thickness of about 0.050 inches and an offset of about 0.082 inches. The height of the short arm is about 0.188 inches and the height of the long arm is about 0.750 inches. A preferable material is aluminum.

Referring now to FIGS. 8, 9 and 10 it can be seen that the top attachment clip is simply and inexpensively constructed. The clip 118 has a generally U-shaped profile with a base 120 and two legs 122, 124. Formed from one of the legs is an extending tab 126 having a bump, bend or protrusion 128 formed for engaging the frame 60, FIG. 2, of the wall panel assembly. The clip is made of steel and is about 0.025 inches thick. This allows the tab to be resilient. The clip also has been formed to include two offset fingers 130, 132 for the purpose of forming an interference fit with the two small rectangular openings of each group of openings in the bracket. The attachment clip is relatively small having a height dimension of approximately 0.90 inches, a width dimension of about one inch and a tab extension of about 0.6 inches.

Figure 11:
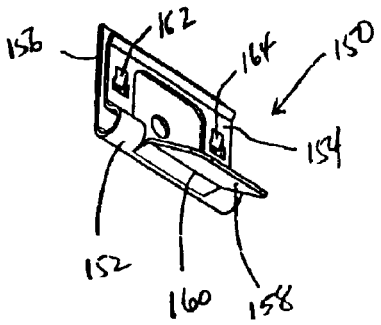
FIG. 11 is a front isometric view of a bottom clip of the universal connector.
Figure 12:
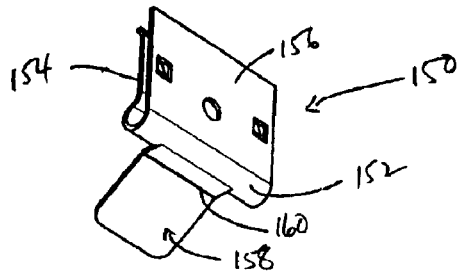
FIG. 12 is a rear isometric view of the bottom clip.
Figure 13:
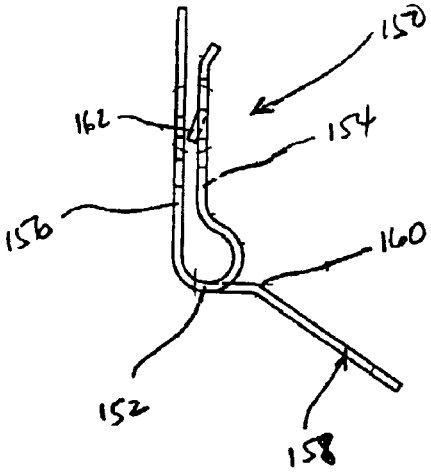
FIG. 13 is an enlarged elevation view of the bottom clip.
Figure 14:
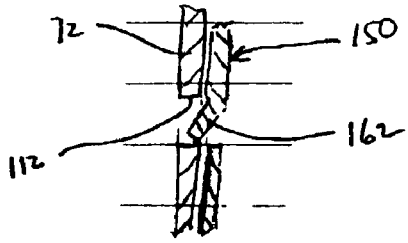
FIG. 14 is an enlarged partial sectional view of an attached bottom clip and bracket.

The bottom attachment clip 150, FIGS. 11–13 is almost identical to the top clip and includes a base 152 and two legs 154, 156. Formed from the leg 154 is an extending tab 158 having a slight bend 160. The tab 158, like the tab 126, functions to connect the connector to the frame of a wall panel assembly. The bottom clip is also made of steel with the same thickness as the top clip so that the tab 158 is resilient. The bottom clip has similar dimensions to that of the top clip and also include two offset fingers 162, 164. The interference fit between the finger 162 and the bottom connector 72 through the opening 112 is illustrated in FIG. 14.

The clips are connected to the bracket by slipping one leg through the slot-like opening of the bracket and when the offset fingers are aligned with the smaller openings corresponding to the slot-like openings, the leg is biased back to cause an abutment between the bracket material bordering the small openings and the fingers.

The top connector and bottom connector are engaged with the top and bottom horizontal edges of a tile and the tile may then be engaged with a frame. Because the top and bottom connectors have the U-shaped portions, they may engage any tile having about a quarter-inch thickness. As mentioned, the tile may be wood and metal and also glass, plastic, natural or painted or covered with material. The tile may be paper or parchment or even a sandwich such as wire screens to either side of a layer of small stones. To help connect a tile to a connector, an adhesive 170, FIGS. 3 and 4, may be placed on the first portion of the bracket.

The above specification describes in detail the preferred embodiment[ s] of the present invention. Other examples, embodiments, modifications and variations will, under both the literal claim language and the doctrine of equivalents, come within the scope of the invention defined by the appended claims. For example, changing the shape of the bracket or the clips are still considered to be equivalent structures. Further, they will come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A universal wall panel tile connector comprising:

an elongated bracket having a first portion with a U-shaped configuration, a second portion in the form of a strip of generally constant cross section and a middle portion having an offset, said bracket for supporting a wall panel and including groups of spaced apart apertures extending through said bracket, one aperture of said group of apertures being located at the offset of said middle portion, each group of spaced apart apertures includes three apertures, an elongated slot and two smaller rectangular-shaped holes; and a plurality of clips connected to said bracket, each of said clips being connected to said bracket by extending through a corresponding aperture in one of said groups of apertures, said clips for connecting said bracket to a wall panel frame.

2. The apparatus as claimed in claim 1 wherein:

each clip of said plurality of clips includes two small offset fingers, each finger for entering a corresponding smaller rectangular-shaped hole and forming an abutment.

3. The apparatus as claimed in claim 2 wherein:

each clip of said plurality of clips has a generally U-shaped configuration and an extending tab.

4. The apparatus as claimed in claim 3 wherein:

said extending tab is bent.

5. A universal wall panel tile connector comprising:

an elongated bracket having a first portion with a U-shaped configuration, a second portion in the form of a strip of generally constant cross-section and a middle portion having an offset, said bracket for supporting a wall panel and including groups of spaced apart apertures extending through said bracket, one aperture of said group of apertures being located at the offset of said middle portion; and a plurality of clips connected to said bracket, each of said clips being connected to said bracket by extending through a corresponding aperture in one of said groups of apertures, said clips for connecting said bracket to a wall panel frame, each clip of said plurality of clips having a generally U-shaped configuration and an extending tab, and including a base and two legs, one of said legs extending through said corresponding aperture of each of said groups of apertures wherein said two legs are positioned on opposite sides of said second portion of said bracket.

6. The apparatus as claimed in claim 5 wherein:

each of said plurality of clips includes offset fingers; and each of said groups of apertures includes apertures for receiving said offset fingers.

7. The apparatus as claimed in claim 6 wherein:

each of said groups of apertures includes two apertures in said second portion of said bracket and one aperture in said middle portion of said bracket, said one aperture in said middle portion for receiving said one of said two legs of said clips and said two apertures in said second portion for receiving said offset fingers of said clips.

8. A wall panel tile connector comprising:

a first elongated bracket having a first portion with a U-shaped configuration, a second portion, a third middle portion having an offset and a plurality of groups of apertures;

a second elongated bracket having a first portion with a U-shaped configuration, a second portion, a third middle portion having an offset and a plurality of groups of apertures;

said first elongated bracket for engaging a top edge of a wall panel with said first portion of said first elongated bracket;

said second elongated bracket for engaging a bottom edge of said wall panel with said first portion of said second elongated bracket; and a plurality of clips connected to each bracket, each clip of said plurality of clips being connected to said brackets by extending through one aperture in a group of apertures of each of said groups of apertures; and wherein each clip of said plurality of clips includes a base and two legs, one of said legs extending through said one aperture of said groups of apertures to position said two legs on opposite sides of a corresponding bracket;

said two legs are positioned on opposite sides of said second portions of said brackets;

each clip of said plurality of clips includes offset fingers; and each group of apertures of said groups of apertures includes apertures for receiving said offset fingers.

9. A connector for wall panel tile comprising:

a first bracket structure to engage one part of said wall panel tile;

a second bracket structure to engage another part of said wall panel tile, each of said first and second brackets including a plurality of aperture clusters, each cluster having the same number of apertures;

a plurality of clips connected to each of said first and second brackets, each clip of said plurality of clips extends through one aperture of each of said cluster of apertures, each clip includes structure for engaging through another aperture of each of said clusters of apertures, and each of said clusters of apertures includes three apertures, and said three apertures include two smaller rectangular-shaped holes and one larger rectangular-shaped hole.

* * * * *